US008186954B2

(12) United States Patent
Lee et al.

(10) Patent No.: US 8,186,954 B2
(45) Date of Patent: May 29, 2012

(54) GAS TURBINE ENGINE ROTOR AND BALANCE WEIGHT THEREFOR

(75) Inventors: Michael J. Lee, Peabody, MA (US); Jamie A. Cushman, Newburyport, MA (US); Kevin Norcott, Waltham, MA (US)

(73) Assignee: General Electric Company, Schenectady, NY (US)

( * ) Notice: Subject to any disclaimer, the term of this patent is extended or adjusted under 35 U.S.C. 154(b) by 906 days.

(21) Appl. No.: 12/241,953

(22) Filed: Sep. 30, 2008

(65) Prior Publication Data

US 2010/0080689 A1 Apr. 1, 2010

(51) Int. Cl.
*F04D 29/00* (2006.01)

(52) U.S. Cl. ..... 416/144; 416/145

(58) Field of Classification Search ..... 415/119, 415/131, 9, 145; 416/144, 142, 94, 145, 416/16, 50

See application file for complete search history.

(56) References Cited

U.S. PATENT DOCUMENTS

| | | | | |
|---|---|---|---|---|
| 2,639,885 | A * | 5/1953 | Ledwith | 416/201 R |
| 3,070,351 | A * | 12/1962 | Hunt, Jr. | 416/221 |
| 3,304,053 | A * | 2/1967 | Pagluica | 416/145 |
| 3,736,811 | A | 6/1973 | Neary | |
| 4,477,226 | A | 10/1984 | Carreno | |
| 5,018,943 | A | 5/1991 | Corsmeier et al. | |
| 5,205,189 | A | 4/1993 | Wesling et al. | |
| 5,280,736 | A | 1/1994 | Wesling et al. | |
| 6,279,420 | B1 | 8/2001 | Knorowski et al. | |
| 6,477,916 | B2 | 11/2002 | Knorowski et al. | |
| 6,481,969 | B2 | 11/2002 | Berry et al. | |
| 7,371,042 | B2 | 5/2008 | Lee | |
| 2007/0128385 | A1 | 6/2007 | Kennedy et al. | |

* cited by examiner

*Primary Examiner* — Thomas L Dickey
*Assistant Examiner* — Nikolay Yushin
(74) *Attorney, Agent, or Firm* — David J. Clement; Trego, Hines & Ladenheim, PLLC

(57) ABSTRACT

A balance weight for a rotor includes: (a) an arcuate body including a front wall and a rear wall interconnected by an end wall, the front, rear, and end walls collectively defining a generally U-shaped cross-sectional shape; and (b) a projection extending outwardly from the rear wall, the projection being adapted to engage an aperture extending through a flange of the rotor.

16 Claims, 8 Drawing Sheets

GAS TURBINE ENGINE ROTOR AND BALANCE WEIGHT THEREFOR

BACKGROUND OF THE INVENTION

This invention relates to the balancing of turbine rotors in gas turbine engines, and, more particularly, to boltless balance weights for rotor disks of such engines.

Gas turbine engines include one or more rotors comprising a disk carrying a plurality of airfoil-shaped turbine blades which extract energy from combustion gases. Because of the high rotational speeds of the disks and the large disk and blade masses, proper balancing of the rotors of the turbine is important. Unbalance may, in some cases, seriously affect the rotating assembly bearings and engine operation.

One known method of balancing a rotor disk is to provide the disk with dedicated balance planes incorporating extra material. These can be selectively ground away as needed. However, this process is difficult to implement efficiently and with repeatable results.

Another known method for balancing turbine disks is to add washers or other weights to select bolted joints of the rotors. The number, position, and mass of the weighted washers needed to balance the disk is dependent on the balance characteristics of each turbine disk being balanced. These balance characteristics are determined by a balance test on each rotor. After finding the unbalance of a turbine rotor, the weighted washers are added to designated bolted joints until the rotor is balanced. While this method works well for turbine rotors with bolted joints, not all turbine rotors have such joints.

BRIEF SUMMARY OF THE INVENTION

These and other shortcomings of the prior art are addressed by the present invention, which provides a boltless balance weight for use with turbine rotors.

According to one aspect of the invention, a balance weight for a rotor includes: (a) an arcuate body including a front wall and a rear wall interconnected by an end wall, the front, rear, and end walls collectively defining a generally U-shaped cross-sectional shape; and (b) a projection extending outwardly from the rear wall, the projection being adapted to engage an aperture extending through a flange of the rotor.

According to another aspect of the invention, a turbine rotor assembly includes: (a) a rotatable disk adapted to carry a plurality of turbine blades at its rim; (b) a flange arm extending axially from a surface of the disk; (c) a radially-extending flange disposed at a distal end of the flange arm, the flange having a plurality of apertures extending therethrough; and (d) a balance weight disposed in a slot cooperatively defined by the disk, the flange arm, and the flange, the balance weight having: (i) an arcuate body including a front wall and a rear wall interconnected by an end wall, the front, rear, and end walls collectively defining a generally U-shaped cross-sectional shape; and (ii) a projection extending outwardly from the rear wall, the projection engaging one of the apertures of the turbine rotor, so as to secure the balance weight to the turbine rotor.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
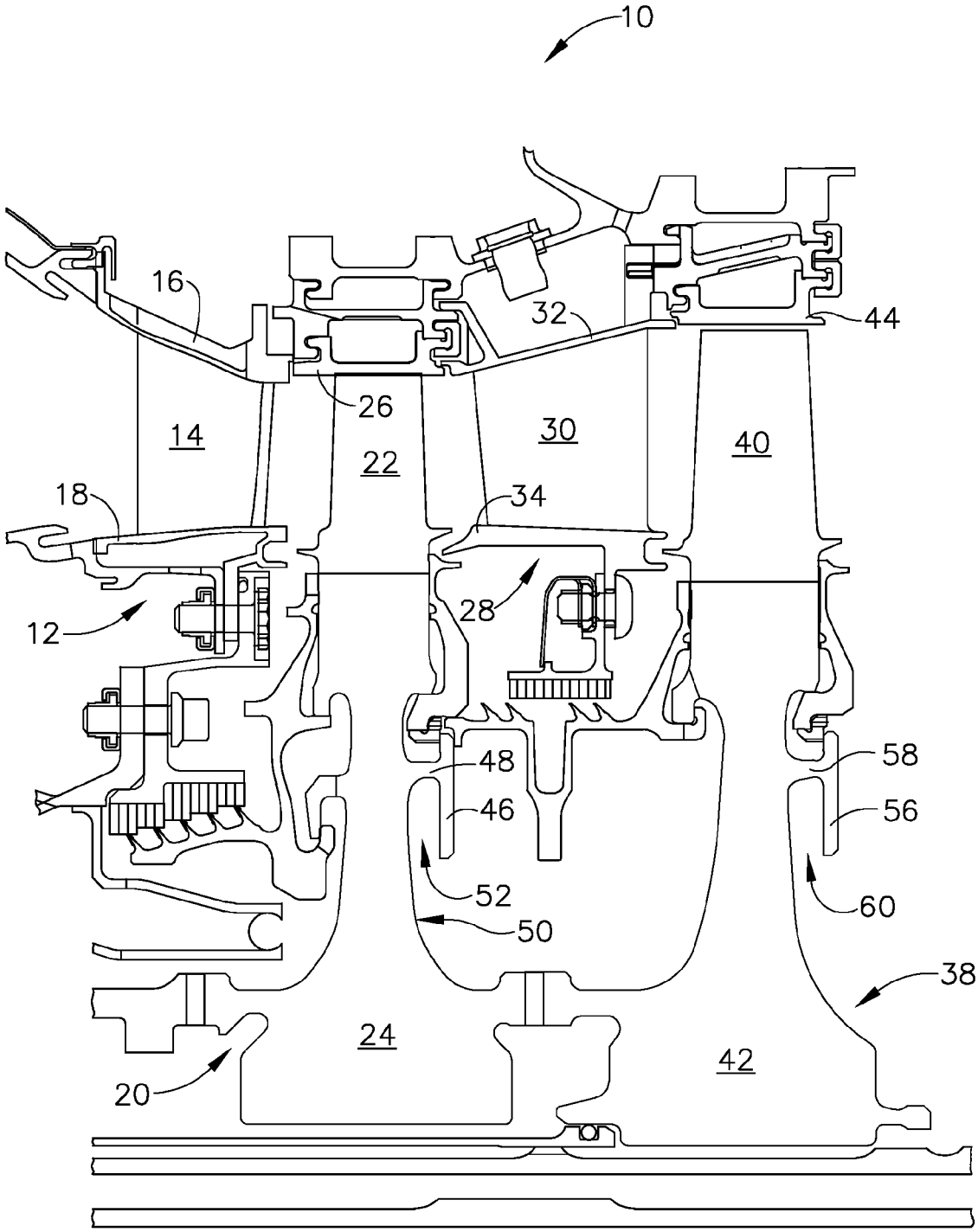
FIG. 1 is a cross-sectional view of a portion of a gas turbine engine including two turbine rotor stages constructed according to an aspect of the present invention.

Referring to the drawings wherein identical reference numerals denote the same elements throughout the various views, FIG. 1 depicts a portion of a gas generator turbine 10, which is part of a gas turbine engine of a known type. The function of the gas generator turbine 10 is to extract energy from high-temperature, pressurized combustion gases from an upstream combustor (not shown) and to convert the energy to mechanical work, in a known manner. The gas generator turbine 10 drives an upstream compressor (not shown) through a shaft so as to supply pressurized air to a combustor.

In the illustrated example, the engine is a turboshaft engine and a work turbine (not shown) would be located downstream of the gas generator turbine 10 and coupled to an output shaft. This is merely one example of a possible turbine configuration, and the principles described herein are equally applicable to rotors of similar or different configuration used in turbofan and turbojet engines, as well as turbine engines used for other vehicles or in stationary applications, as well as rotors that require balancing in other types of machinery.

The gas generator turbine 10 includes a first stage nozzle 12 which comprises a plurality of circumferentially spaced airfoil-shaped hollow first stage vanes 14 that are supported between an arcuate, segmented first stage outer band 16 and an arcuate, segmented first stage inner band 18. The first stage vanes 14, first stage outer band 16 and first stage inner band 18 are arranged into a plurality of circumferentially adjoining nozzle segments that collectively form a complete 360° assembly. The first stage outer and inner bands 16 and 18 define the outer and inner radial flowpath boundaries, respectively, for the hot gas stream flowing through the first stage nozzle 12. The first stage vanes 14 are configured so as to optimally direct the combustion gases to a first stage rotor 20.

The first stage rotor 20 includes a array of airfoil-shaped first stage turbine blades 22 extending outwardly from a first stage disk 24 that rotates about the centerline axis of the engine. A segmented, arcuate first stage shroud 26 is arranged so as to closely surround the first stage turbine blades 22 and thereby define the outer radial flowpath boundary for the hot gas stream flowing through the first stage rotor 20.

A second stage nozzle 28 is positioned downstream of the first stage rotor 20, and comprises a plurality of circumferentially spaced airfoil-shaped hollow second stage vanes 30 that are supported between an arcuate, segmented second stage outer band 32 and an arcuate, segmented second stage inner band 34. The second stage vanes 30, second stage outer band 32 and second stage inner band 34 are arranged into a plurality of circumferentially adjoining nozzle segments that collectively form a complete 360° assembly. The second stage outer and inner bands 32 and 34 define the outer and inner radial flowpath boundaries, respectively, for the hot gas stream flowing through the second stage turbine nozzle 28. The second stage vanes 30 are configured so as to optimally direct the combustion gases to a second stage rotor 38.

The second stage rotor 38 includes a radial array of airfoil-shaped second stage turbine blades 40 extending radially outwardly from a second stage disk 42 that rotates about the centerline axis of the engine. A segmented arcuate second stage shroud 44 is arranged so as to closely surround the second stage turbine blades 40 and thereby define the outer radial flowpath boundary for the hot gas stream flowing through the second stage rotor 38.

The first stage disk 24 includes a radially-extending annular flange 46. The flange 46 is supported by a flange arm 48 that extends axially from the aft side 50 of the first stage disk 24. Collectively, the first stage disk 24, flange arm 48, and flange 46 define an annular slot 52. The flange 46 has an annular array of apertures 54 formed therethrough (see FIG. 4). The second stage disk 42 is similar in configuration to the first stage disk 24 and includes an annular flange 56, flange arm 58, and slot 60.

Figure 2:
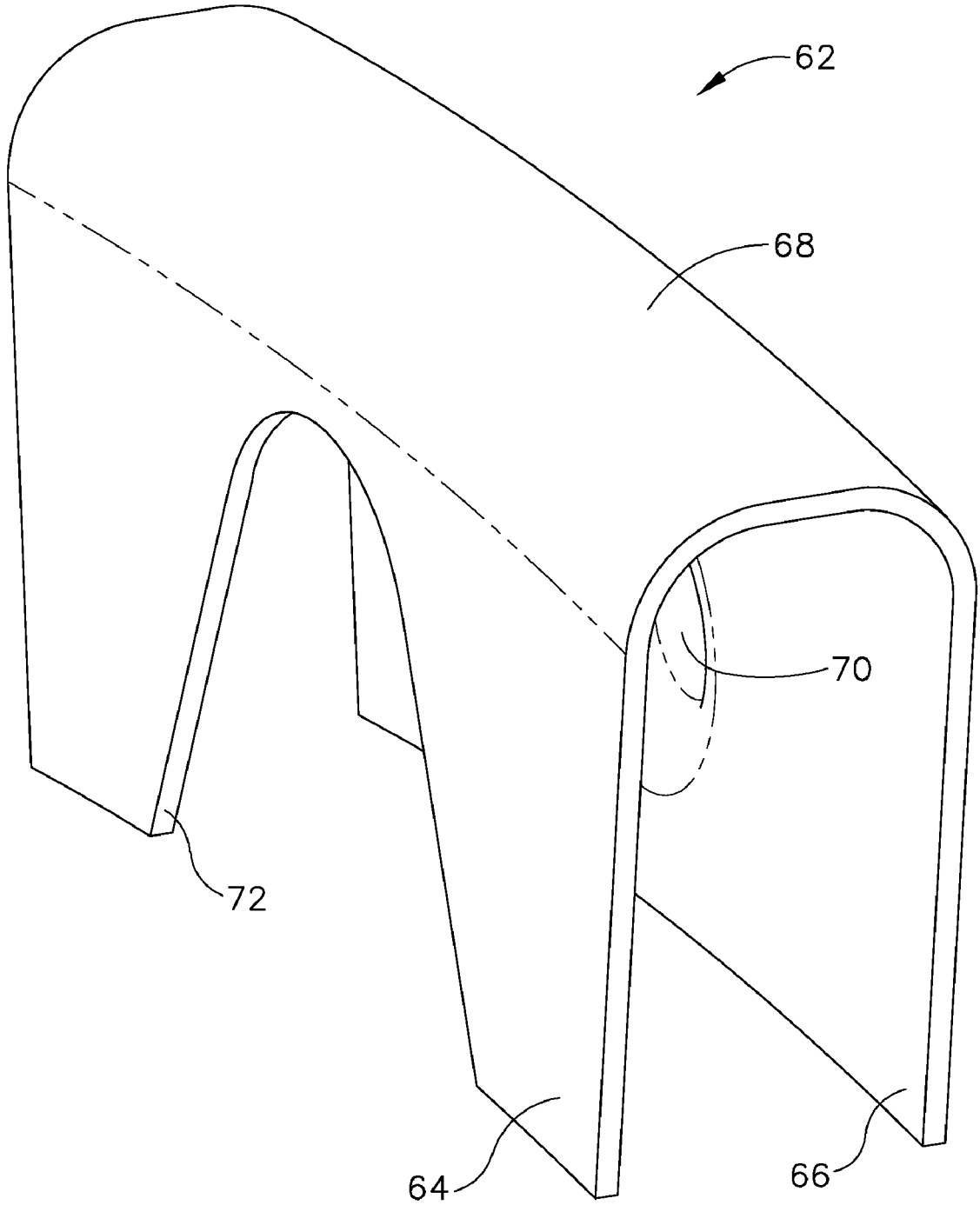
FIG. 2 is a front perspective view of a balance weight for use with a gas turbine rotor.
Figure 3:
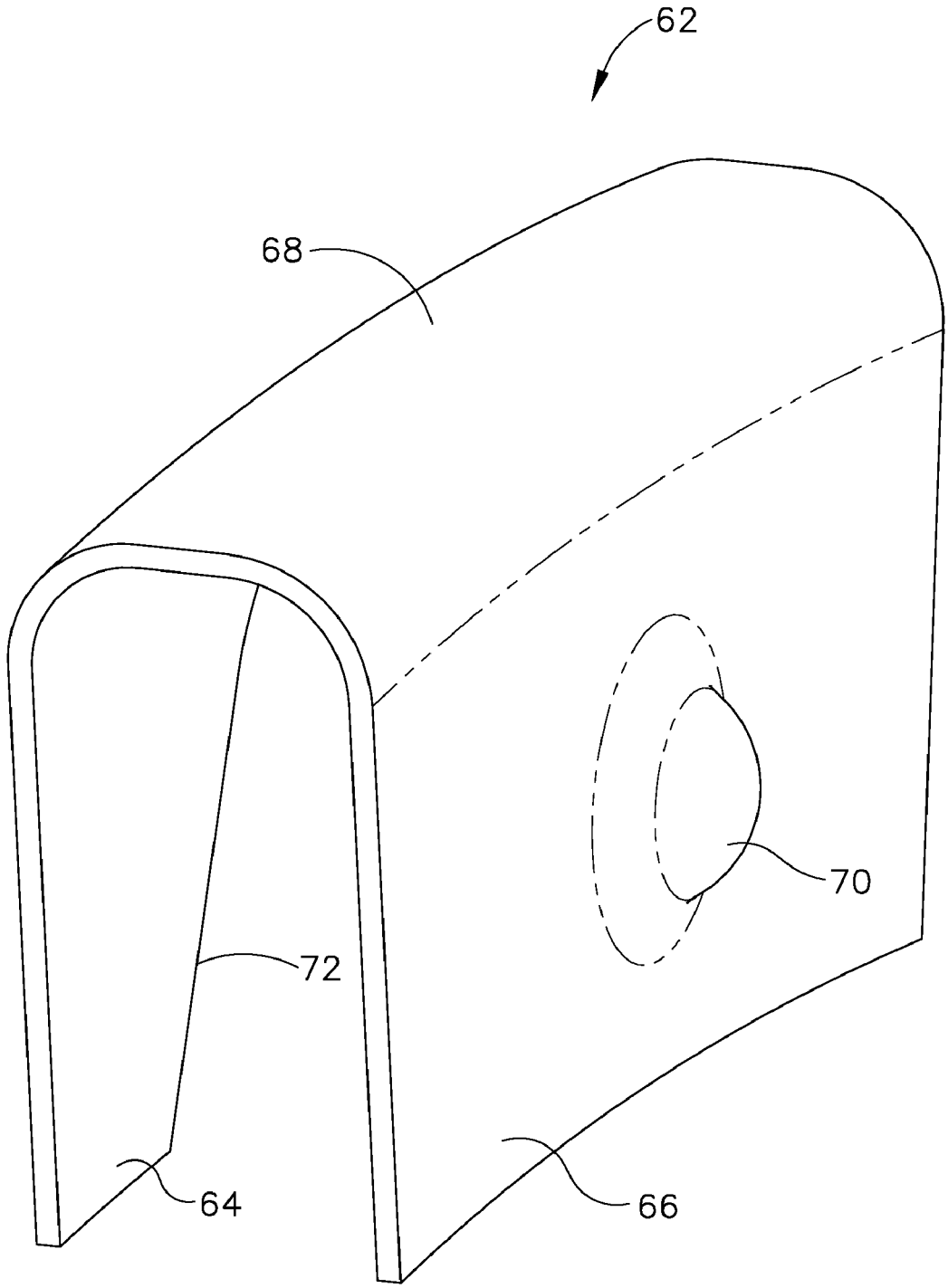
FIG. 3 is a rear perspective view of the balance weight of FIG. 2.

FIGS. 2 and 3 illustrate an exemplary balance weight 62 for use with the disks 24 and 42. The balance weight 62 is generally U-shaped in cross-section and includes spaced-apart front and rear walls 64 and 66 interconnected by an end wall 68. The balance weight 62 is made from a suitable alloy and may be formed by methods such as casting, stamping, or machining. The balance weight 62 is slightly resilient, such that the front and rear walls 64 and 66 can be compressed towards each other for installation but will spring back to their original shape.

The rear wall 66 of the balance weight 62 includes a dimple 70 protruding outwardly therefrom. In the illustrated example, the front wall 64 includes a cutout 72 which is aligned with the lateral and radial position of the dimple 70, to allow the dimple 70 to be formed in the rear wall 66 using a forming die or other similar tooling. Depending on the method of manufacture, the cutout 72 may be eliminated. The overall dimensions, material thickness, and specific cross-sectional profile of the balance weight 62 may be varied in size to increase or decrease its mass as required for a particular application.

Figure 4:
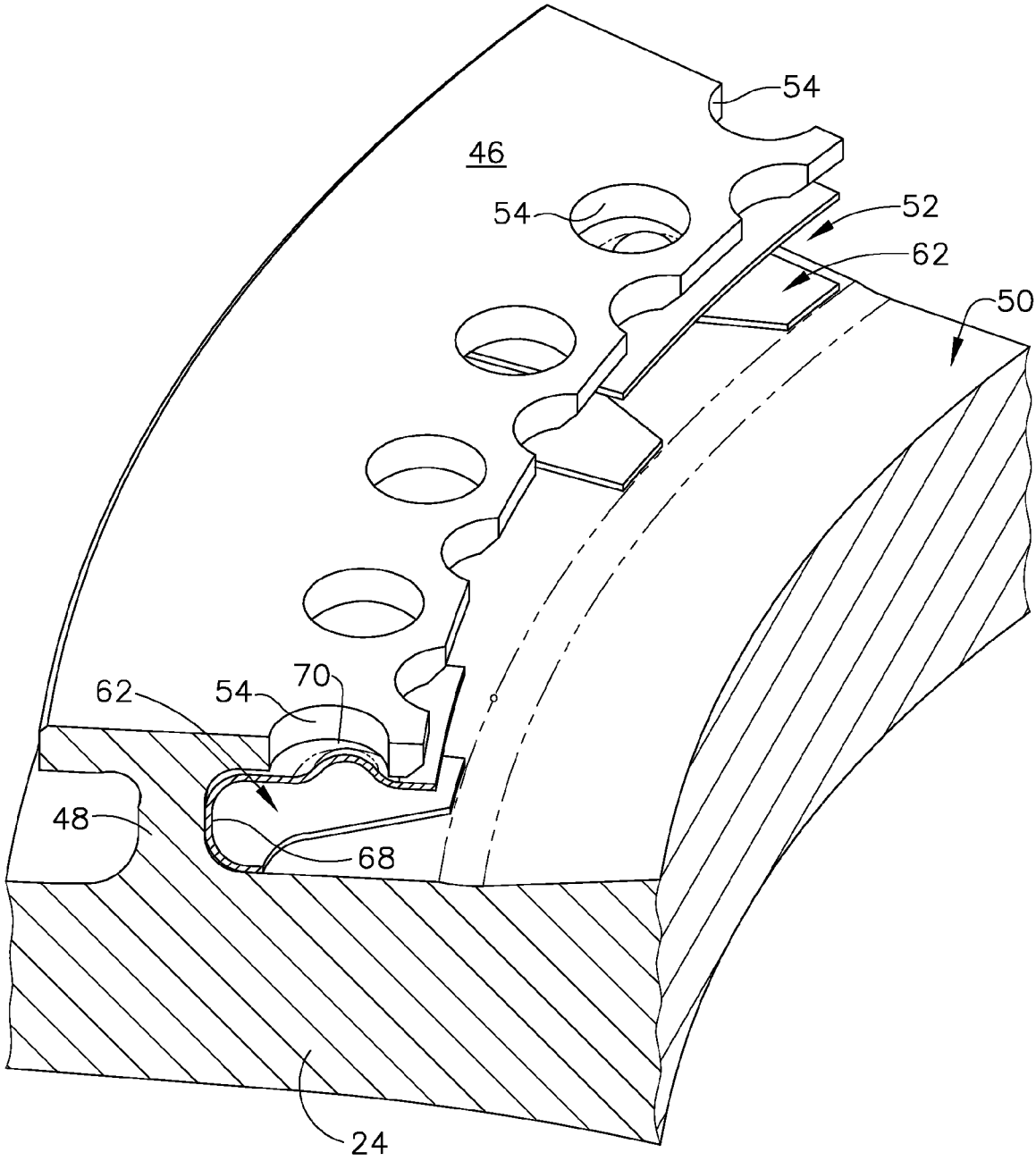
FIG. 4 is a partial perspective view of a disk with the balance weight of FIG. 2 installed therein.

FIG. 4 illustrates how the balance weight 62 is installed. It will be understood that the installation process is identical for the first and second disks 24 and 42, and therefore will only be discussed with respect to disk 24. The balance weight 62 is positioned in the slot 52 by compressing the balance weight 62 such that it slides between the aft side 50 of the first stage disk 24 and the flange 46. The balance weight 62 is positioned such that the dimple 70 is aligned with one the apertures 54 in the flange 46. Once the dimple 70 is aligned with the aperture 54, the balance weight 62 is released to allow it to expand in the slot 52, forcing the dimple 70 into the aperture 54 and thereby securing the balance weight 62.

At a static condition, the balance weight 62 will be retained by the dimple engagement and friction forces. During operation of the turbine 10, the balance weight 62 is further secured within the slot 52 by rotational forces caused by the rotation of the first stage disk 24. In particular, there is a small space between the end wall 68 of the balance weight 62 and the inner diameter of the flange arm 48. During engine operation, this allows the balance weight 62 to rotate aft with a "hammer head" effect under centrifugal force, urging the dimple 70 into the aperture 54, thus providing redundant retention in the first stage disk 24.

Figure 5:
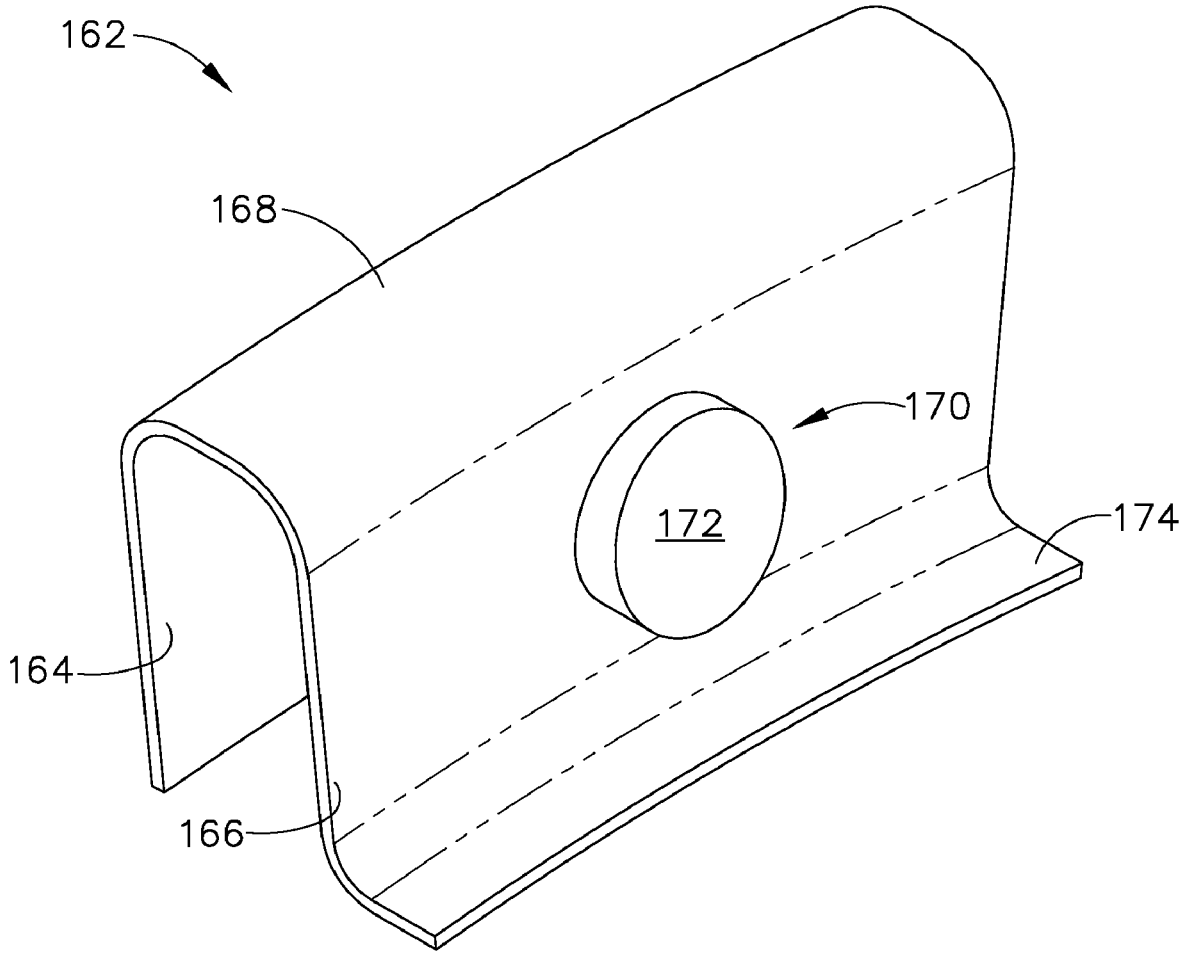
FIG. 5 is a rear perspective view of a balance weight for use with a turbine rotor.
Figure 6:
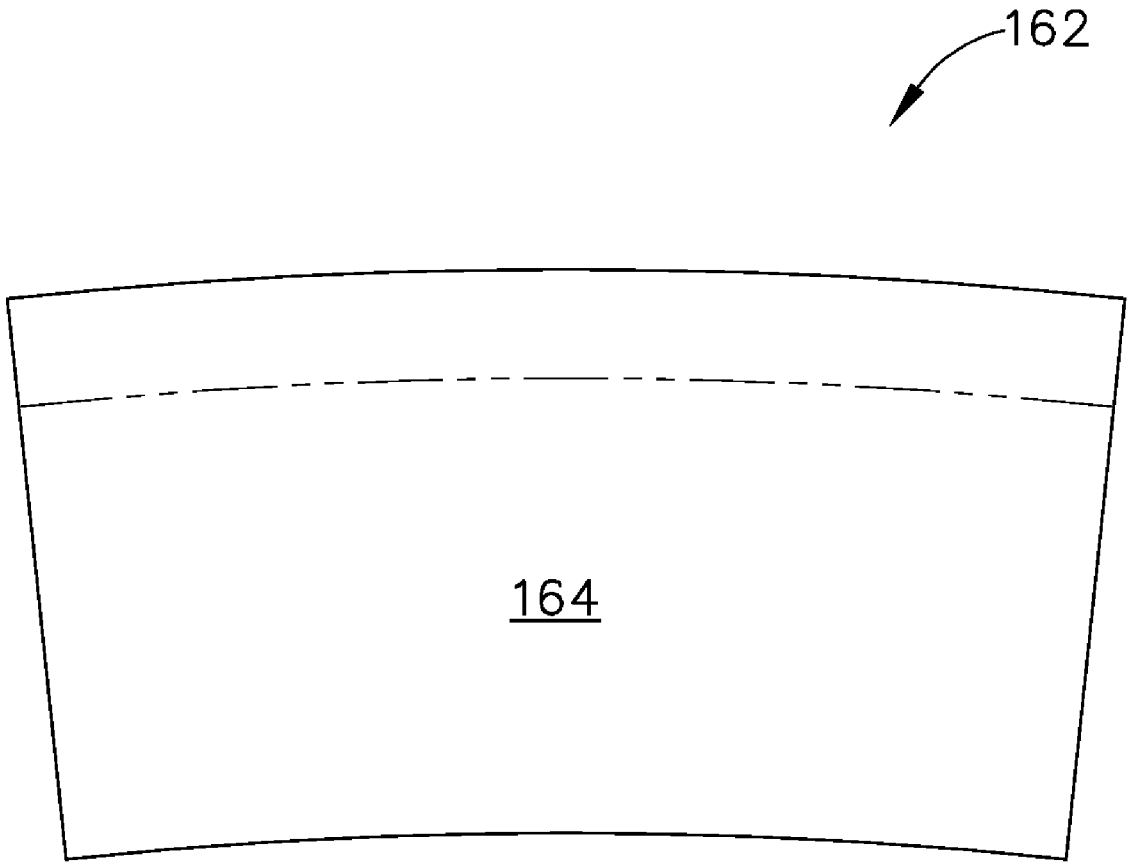
FIG. 6 is a front view of the balance weight of FIG. 5.
Figure 7:
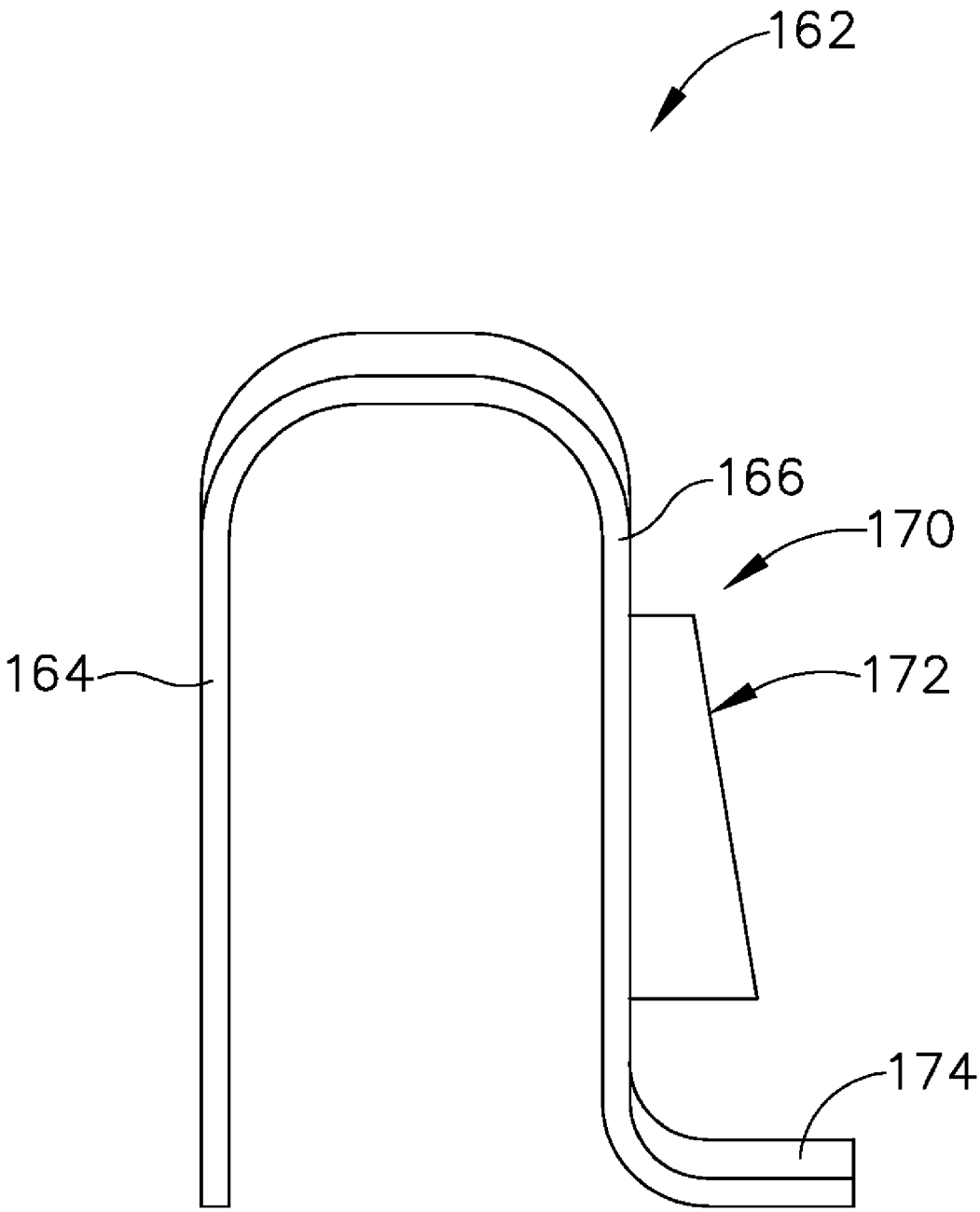
FIG. 7 is a side view of the balance weight of FIG. 5.

FIGS. 5-7 illustrate an alternative balance weight 162 which is similar in construction to the balance weight 162 and includes spaced-apart front and rear walls 164 and 166 interconnected by an end wall 168. The balance weight 162 is made from a suitable alloy and may be formed by methods such as casting, stamping, or machining. The balance weight 162 is slightly resilient, such that the front and rear walls 164 and 166 can be compressed towards each other for installation but will spring back to their original shape.

The rear wall 166 includes a pin 170 protruding outwardly therefrom. The pin 170 may be a separate element which is attached to the rear wall 166 by brazing or welding, or it may be integrally formed with the rear wall 166. As shown, an aft face 172 of the pin 170 is angled or sloped radially outward to ease installation of the balance weight 162; however, it should be appreciated that the aft face 172 may also be flat or have any other suitable geometry.

A lip 174 extends axially aft from a radially inner edge of the rear wall 166. The lip 174 may be sized according to the amount of mass needed for balancing, and may also provide additional stability when the balance weight 162 is installed. The overall dimensions, material thickness, and specific cross-sectional profile of the balance weight 162 may be varied in size to increase or decrease its mass as required for a particular application.

Figure 8:
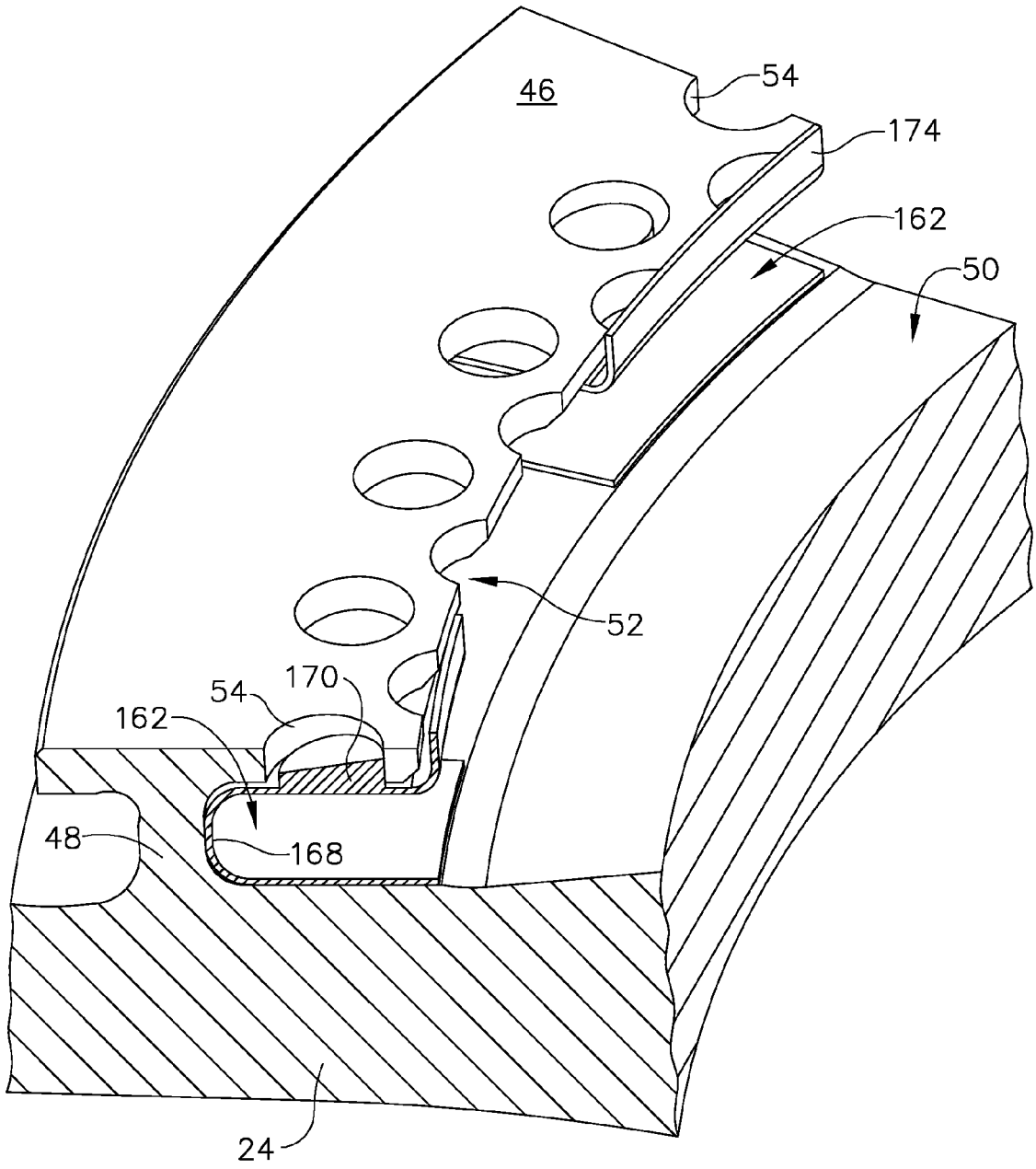
FIG. 8 is a partial perspective view of a disk with the balance weight of FIG. 5 installed therein.

FIG. 8 illustrates how the balance weight 162 is installed. As with the balance weight 62, it will be understood that the installation process is identical for the first and second stage disks 24 and 42, and therefore will only be discussed with respect to disk 24. The balance weight 162 is positioned in the slot 52 by compressing it such that it slides between the aft side 50 of the first stage disk 24 and the flange 46. The balance weight 162 is positioned such that the pin 170 is aligned with one the apertures 54 in the flange 46. Once the pin 170 is aligned with the aperture 76, the balance weight 162 is released to allow it to expand in the slot 52, forcing the pin 170 into the aperture 54 and thereby securing the balance weight 162.

At a static condition, the balance weight 162 will be retained by the pin engagement and friction forces. During operation of the turbine 10, the balance weight 162 is further secured within the slot 52 by rotational forces caused by the rotation of the first stage disk 24. In particular, there is a small space between the end wall 168 of the balance weight 162 and the inner diameter of the flange arm 48. During engine operation, this allows the balance weight 162 to rotate aft with a "hammer head" effect under centrifugal force, urging the pin 170 into the aperture 54, thus providing redundant retention in the disk.

The foregoing has described a balance weight for a turbine rotor. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation.

What is claimed is:

1. A balance weight for a rotor, comprising:

(a) an arcuate body including a front wall and a rear wall interconnected by an end wall, the front, rear, and end walls collectively defining a generally U-shaped cross-sectional shape; and (b) a projection extending outwardly from the rear wall, the projection being adapted to engage an aperture having a closed perimeter extending through a flange of the rotor.

2. The balance weight according to claim 1, wherein the projection is a dimple formed in the rear wall.

3. The balance weight according to claim 1, wherein the projection is a pin secured to the rear wall.

4. The balance weight according to claim 1 wherein the arcuate body is constructed from a material permitting resilient deflection of the front and rear walls towards or away from each other.

5. The balance weight according to claim 1, wherein a lip extends axially aft from a radially inner edge of the rear wall.

6. The balance weight according to claim 1, wherein the projection is a pin integrally-formed with the rear wall.

7. The balance weight according to claim 6, wherein the pin has a rear face which is angled in a radially outward direction adapted to allow the pin to easily engage the aperture.

8. A turbine rotor assembly, comprising:

(a) a rotatable disk adapted to carry a plurality of turbine blades at its rim;

(b) a flange arm extending axially from a surface of the disk;

(c) a radially-extending flange disposed at a distal end of the flange arm, the radially-extending flange having a plurality of apertures each having a closed perimeter extending therethrough; and (d) a balance weight disposed in a slot cooperatively defined by the disk, the flange arm, and the flange, the balance weight comprising:

(i) an arcuate body including a front wall and a rear wall interconnected by an end wall, the front, rear, and end walls collectively defining a generally U-shaped cross-sectional shape; and (ii) a projection extending outwardly from the rear wall, the projection engaging one of the apertures of the turbine rotor, so as to secure the balance weight to the turbine rotor.

9. The turbine rotor assembly according to claim 8, wherein the projection is a pin secured to the rear wall of the balance weight.

10. The turbine rotor assembly according to claim 8, wherein the projection is a pin integrally-formed with the rear wall of the balance weight.

11. The turbine rotor assembly according to claim 10, wherein the pin has a rear face which is angled in a radially outward direction adapted to allow the pin to easily engage the aperture.

12. The turbine rotor assembly according to claim 8 wherein the arcuate body is constructed from a material permitting resilient deflection of the front and rear walls, such that the front and rear walls are urged against the disk and the radially-extending flange, respectively.

13. The turbine rotor assembly according to claim 8, wherein a lip extends axially aft from a radially inner edge of the rear wall of the balance weight.

14. The turbine rotor assembly according to claim 8, wherein the balance weight is positioned in the slot such that front wall is adjacent to the turbine rotor and the rear wall is positioned adjacent to an inside surface of the radially-extending flange.

15. The turbine rotor assembly according to claim 8, wherein the projection is a dimple formed in the rear wall of the balance weight.

16. The turbine rotor assembly according to claim 15, wherein the radially-extending flange is disposed on an aft side of the turbine rotor.

* * * * *